United States Patent [19]

Lang

[11] 4,315,379

[45] Feb. 16, 1982

[54] HAND GUN GRIP WITH CONCEALED FASTENERS

[76] Inventor: Alan J. Lang, 26025 Scott Rd., Sun City, Calif. 92381

[21] Appl. No.: 122,567

[22] Filed: Feb. 19, 1980

[51] Int. Cl.[3] ..... F41C 23/00

[52] U.S. Cl. ..... 42/71 P

[58] Field of Search ..... 42/71 P

[56] References Cited

U.S. PATENT DOCUMENTS

| | | | |
|---|---|---|---|
| 2,308,627 | 1/1943 | Rickenbacher | 42/71 P |
| 3,672,084 | 6/1972 | Pachmayr | 42/71 P |
| 3,815,270 | 6/1974 | Pachmayr | 42/71 P |
| 4,043,066 | 8/1977 | Pachmayr et al. | 42/71 P |
| 4,132,024 | 1/1979 | Pachmayr et al. | 42/71 P |
| 4,162,586 | 7/1979 | Pachmayr | 42/71 P |

*Primary Examiner*—Charles T. Jordan

*Attorney, Agent, or Firm*—Wagner & Bachand

[57] ABSTRACT

An improved hand gun grip comprising a body of resilient elastomeric material defining an outer gripping surface and an interior conforming to the frame of the hand gun to which it is to be attached, and including a plurality of mating surfaces having matching recesses. Dumb-bell shaped fasteners rest in the matching recesses and include an enlarged surface bearing against the recess to maintain the grip halves in compressed edge engagement. A peripheral ridge cooperates with the fasteners to insure tight edge contact.

6 Claims, 5 Drawing Figures

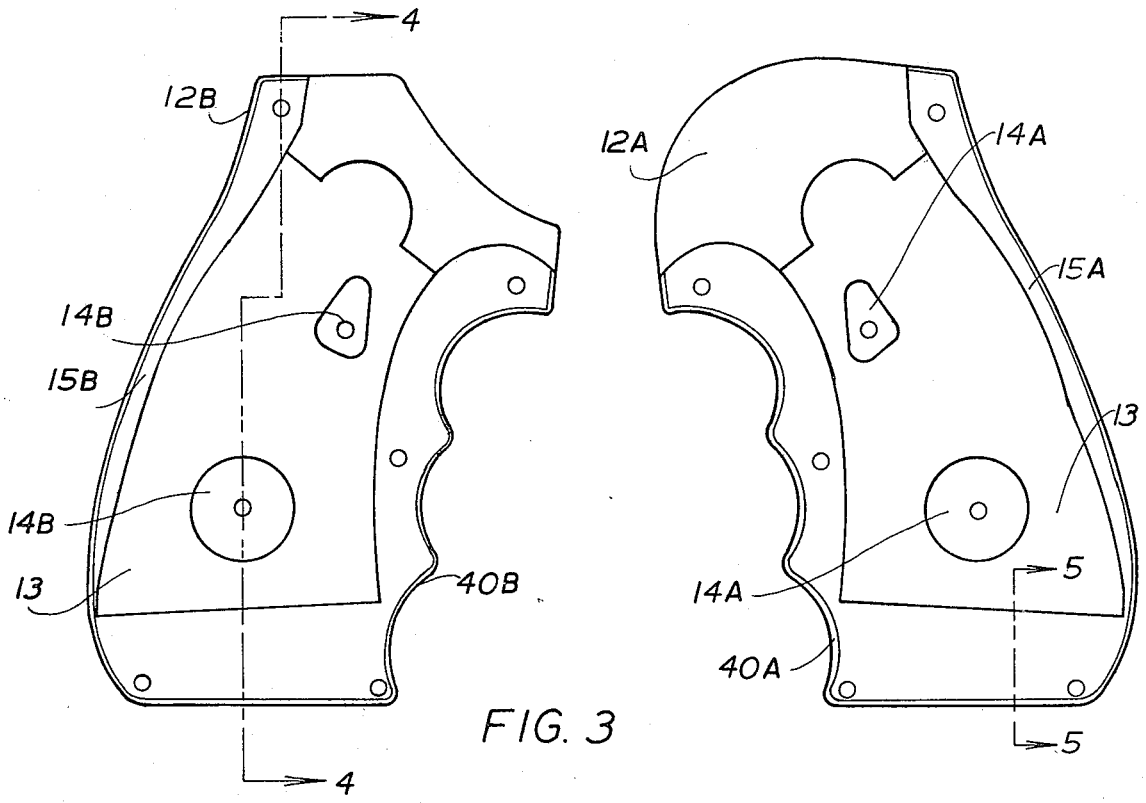
FIG. 3
FIG. 4
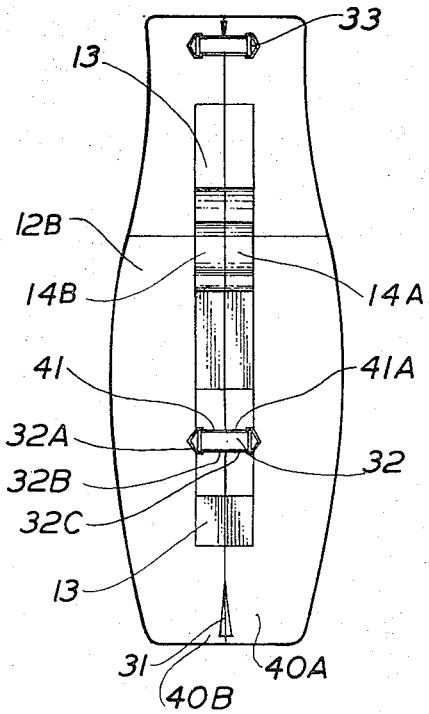
FIG. 5
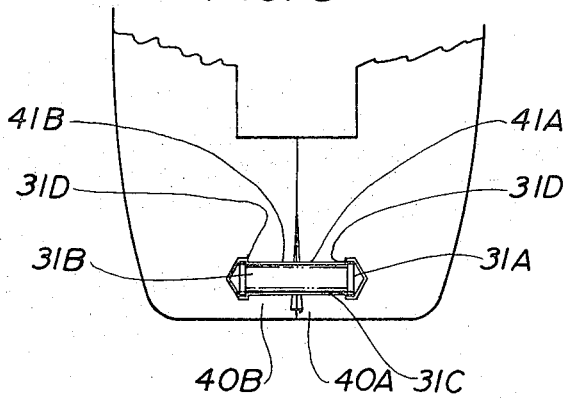

HAND GUN GRIP WITH CONCEALED FASTENERS

BACKGROUND OF THE INVENTION

Characteristically the grip of hand guns have been made of wood or molded rigid plastic material. Sometimes ornamental materials such as mother of pearl have been used. Typically the exterior surface of such hand grips includes cross hatching or other friction improving surface treatment. The objective is to provide a hand fitting grip which is operative to insure a firm grip on the hand gun while in use.

It has recently been discovered that a slightly resilient grip made, for example of 80–85 shore neoprene provides sufficient rigidity for effective gripping. It's resiliencey also improves the comfort to the shooter and provides an improved grip. Many shooters attribute superior accuracy to the resilient type grip.

Unfortunately a resilient elastomer grip by its very nature offers difficulties in attachment to the hand gun frame. The traditional method of securing hand grips to the frame namely a machine screw which with appropriate washer passes through the grip and into a mating machine hole in the frame is not effective. A single such screw attempts to compress the elastomer in the region of the screw causing the edges of the hand grip to bow outward in an unsightly and unsatisfactory condition. This problem has been attacked by the molding of a reinforcing insert to the elastomer. Examples of such approaches appear in U.S. Pat. Nos. 3,672,084, 3,815,270, 4,043,066, and 3,696,706.

The attempt in the molded insert arrangement is to provide a broader surface, for example, two thirds of the area of the hand grip with a reinforcement. This type of hand grip has gone significantly toward improvement in resilient elastomer hand grips. It is however only a partial solution.

BRIEF STATEMENT OF THE INVENTION

Faced with the foregoing state of the art, I have produced a resilient elastomer hand grip made up of a pair of parts which are reliably interconnected to the frame of a hand gun without the need of any molded inserts, screws, or washers.

The hand grip is held onto the frame at a plurality of space points including the periphery so that a neat uniform grip assembly with a hardly noticeable seam line is produced. I have further produced such a grip which is easily manufactured and avoids any of the problems of molded inserts. Thus reducing the cost and at the same time providing a more reliable and more attractive grip.

This is accomplished employing a pair of mating grip parts, each having external surfaces conforming with the desired hand grip configuration. The internal surface of the hand grips include relatively large mating areas around the periphery and wherever desired in openings through the frame. A plurality of pairs of matching lipped recesses are located on the mating surfaces. Dumb-bell shaped fastener inserts extend into the recesses. They each include facing surfaces bearing inwardly against the grip to hold the lips of the recesses together providing local compressive stress on the elastomeric material and thereby insuring that the grip parts are held together at a plurality of positions. This provided not only reliable interconnection between the grip and the hand gun frame but a nearly invisible seam line between the two parts. Edge ridges cooperating with the fastener insure tight edge contact.

In the preferred embodiment the recesses in mating parts include a re-entrant portion with a flat bearing surface and the connecting pins include a mating surface. The pins further in the preferred embodiment include tapered points to facilitate attachment of the grips to the hand gun while the flat bearing surfaces engaging the elastomer hand grip provide effective resistance to unwanted release from the grip to the frame.

BRIEF DESCRIPTION OF THE DRAWING

The foregoing invention briefly described may be more clearly understood from the following detailed description and by reference to the drawing, in which:

FIG. 3 is a vertical elevational view of the mating grip parts showing the recesses;

FIG. 4 is a vertical sectional view through the grip and frame assembly of FIG. 3 taken along lines 4—4 of FIG. 3; and FIG. 5 is an enlarged framentary view of the attachment region of the hand grip including locking pins in place.

DETAILED DESCRIPTION OF THE INVENTION

Figure 1:
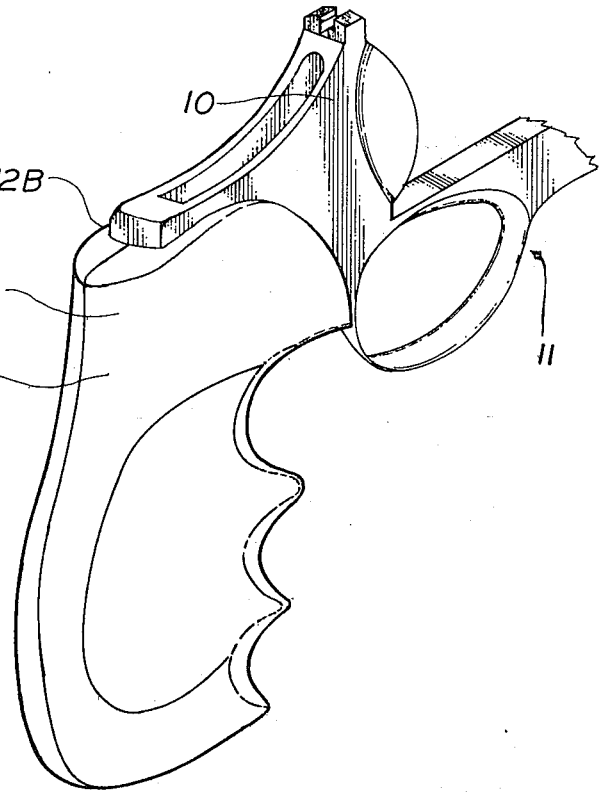
FIG. 1 is a perspective view of a hand gun carrying grip of this invention.

Now referring to FIG. 1 the frame 10 of a hand gun 11 including grip 12 of this invention may be seen therein. The frame displayed is typical of revolver frames and the grip 12 incorporating this invention is typical of the contoured finger larger size grips which have become exceedingly popular with shooters. The particular exterior configuration of the grip 12 will vary with the particular hand gun and the shooter's preferred grip shape. The grip 12 therefore is shown as a typical popular grip and its external configuration will vary significantly from gun to gun. Characteristic, however, of grips in accordance with this invention is the fact that the grip 12 is made up of the pair of parts 12A and 12B both of elastomeric material such as neoprene having a hardness of varying degrees but I have found that neoprene of 80–85 shore provides a very desirable degree of resiliency in the grip. Note that the two parts 12A and 12B making up the grip 12 have a near invisible seam line showing at the rear but with no differentiable separation between the parts. Note also that there are no visible fasteners. This is in direct contrast to all the prior art grips not incorporated in this invention and achieving the near invisible seam line. The two grip parts 12A and 12B may be identical mirror images of each other or as is the case of the grip shown in FIG. 1 and more clearly viewed in FIG. 2, the left side of the grip is of a lower contour to allow the right hand shooter's thumb to reach the thumb safety and to provide clearance for the loading of the cylinder of the revolver.

Figure 2:
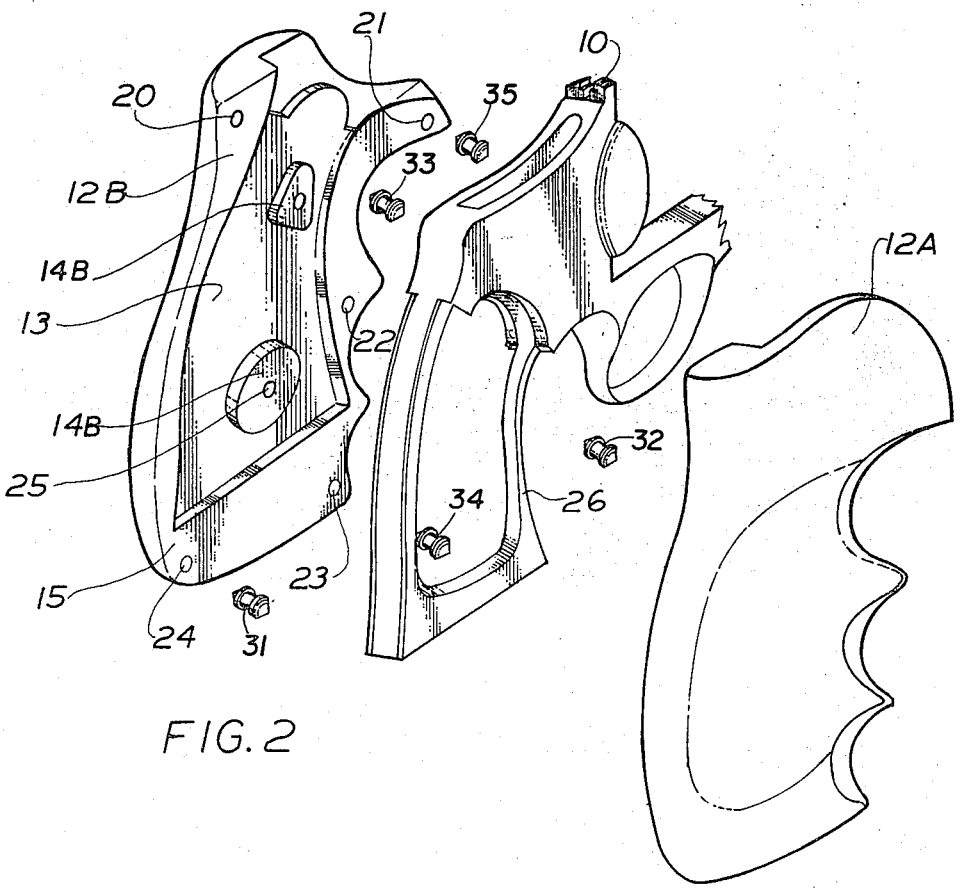
FIG. 2 is an exploded view of the frame and grip parts of this invention.

Now referring to the FIG. 2 in conjunction with FIG. 1, the grip part 12B may be seen to be a unitary body with a recess 13 and a plurality of lands 14 as well as an edge land 15 having an edge ridge hardly visible in FIG. 2 but more apparent in FIGS. 3, 4, and 5. The two grip parts 12A and 12B each include mating recesses 20 through 25. In this particular case, six such recesses are used and six is considered to be a practical minimum for securing a typical grip together. These recesses 20 through 25 are located in the lands 14 and 15 and as close to the edge as practical when located in the edge land 15. The locations of the recesses 20 through 25 will vary of course with the particular gun frame. The internal lands 14 of the grip must avoid any interference with the location and movement of any of the internal mechanism of the hand gun such as the cylinder revolving and hammer springs so the location and size of lands 14 are determined by each particular gun frame.

Positioned between the separated grip parts 12A and 12B of FIG. 2 are a plurality, namely five enlarged end or dumb-bell shaped fasteners 31 through 35. Each such fastener 31–35 is positioned in FIG. 2 to enter the mating recesses of the parts 12A and 12B. Recesses 20–24 of grip part 12B appear in FIG. 2 while those of part 12A are concealed from view. These internal locking devices engage overhanging lips of the mating recesses to hold the grip parts together. This apparatus is more clearly illustrated in FIGS. 4 and 5.

The exact design of the grip 12 and the location of the lands 14A and 14B of the respective hand grip parts can best be seen in FIG. 3. Internally, the parts are virtual mirror images so that they may be brought into engagement with each other and providing continuous recess 13 of sufficient size to receive the frame of the particular hand gun. It is particularly apparent also in FIG. 3 that the land 15 includes the edge ridge 40A and 40B around the entire periphery of the lands 15A and 15B respectively.

I have found that by (a) precise molding of the grip parts with this ridge;

(b) a subsequent verification of flatness; and (c) grinding is reguired to insure a true flat surface aids in obtaining the near invisible seam line as shown in FIG. 1.

The edge ridge 40A and 40B and their cooperation with the fasteners 31 through 35 is best seen in FIGS. 4 and 5 which show the coaction of the fasteners to hold the grip parts 12A and 12B together. FIG. 4 which is a section taken through grips 12A and 12B along the line 4—4 of FIG. 3, shows the lands 14A and 14B, the recess 13 and fasteners 32 and 33 in place. The internal lip designated 41 of the mating opening for fastener 32 provides the engagement point for the enlarged heads of the fasteners 31-35. Note that the fasteners 31 through 35 each have tapered outer heads labelled 31A–35A and 31B–35B respectively and a narrower shank portion 31C–35C respectively. The shank portion such as 31C of FIG. 5 extends between the two heads and flat surface 31D–35D engage the underside of the lips 41 of the elastomeric grip body. In as much as the grip material selected is elastomeric and the heads of the fasteners 31–35 are tapered, it is possible to insert the fasteners by pressure applied to the shank of the fastener to distort the lip 41 sufficiently to allow the entrance of head 32A. The natural resiliency of the material of grip 12 allows the lip 41B to return to its normal position presenting an abutting surface for the underside of the head 32A to engage. Similar operation holds the fastener 32 to the grip part 12A. Note particularly that the edge ridge 40 provides a degree of distortion within the grip between the edge and the nearest fastener, for example 31 of FIG. 5. This distortion maintains the two adjacent ridges 40A and 40B in intimate contact at all times. The details of this cooperation is best seen in FIG. 5 where a noticeable distortion outward occurs at the edge ridges 40A and 40B. The heads 31A and 31B engage the recess lip throughout the periphery of the underside of the lip and thereby providing front area pressure applied to the grip.

Given a plurality of fasteners, for example, 5 or more strategically located around the periphery and the edge ridge the net result is an easily attached invisible fastener resilient hand grip. The hand grip may be removed intentionaly by careful peeling of one side of the grip away from the frame and its mating part. Care must be taken to avoid tearing the lip, however, the best assembly practice which I found is to employ a rubber lubricant when assembling the grip and the residual lubricant can aid in removal when wanted. The exact number of fasteners and their location will vary for various frame and grip configurations. I have found that for most combinations 5 or 6 fasteners suffice. The very invisible nature of my invention makes practical the use of any number of additional fasteners desired.

A principal feature of this invention resides in the fact that the small unobtrusive fasteners may be positioned around the periphery of the grip insuring a nearly invisible seamline while providing effective holding of the grip on the frame. In testing of this grip, repeated dropping of the hand gun on a hard surface fails to dislodge the grip from the hand gun.

Firing the hand gun with all commercial calibers and loads failed to dislodge them.

The overall result is that a far more attractive, resilient grip has been obtained and one produced with lower overall cost to the producer and the consumer.

The above described embodiments of this invention are merely descriptive of its principles and are not to be considered limiting. The scope of this invention instead shall be determined from the scope of the followng claims, including their equivalents.

What is claimed is:

1. A hand grip for hand guns comprising a pair of elastomeric grip parts including mating parts defining a common cavity therebetween for receiving the butt portion of the frame of a handgun;

said mating grip parts, including matching recesses having lips defining a narrow entrance opening for an enlarged recess;

a plurality of fasteners having enlarged heads and narrower shanks for positioning in respective matching recesses with enlarged heads engaging the lips of the recesses to maintain the grip parts together about the frame of the hand gun;

said fasteners concealed within said grip when assembled on a handgun.

2. A combination in accordance with claim 1 wherein each of said recesses includes an underside of the lip presenting a surface for engagement of the respective fastener heads.

3. A combination in accordance with claim 2 wherein said under surface is planar and generally parallel to the mating surfaces of the grip parts in the region adjacent thereto.

4. A combination in accordance with claim 1 wherein said grip parts include at least one land in said common recess and at least one fastener extending between said matching lands.

5. A combination in accordance with claim 1 wherein said grip parts include generally planar matching edge lands to define a peripheral region for securement together.

6. A combination in accordance with claim 1 wherein said grip parts include generally planar edge lands; at least one of which contains a pheripheral ridge whereby the ridge defines a localized area at the periphery for compresive engagement between adjacent grip parts.

* * * * *